US006247525B1

(12) United States Patent
Smith et al.

(10) Patent No.: US 6,247,525 B1
(45) Date of Patent: Jun. 19, 2001

(54) VIBRATION INDUCED ATOMIZERS

(75) Inventors: Marc K. Smith, Marietta; Ari Glezer, Atlanta, both of GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 09/576,729

(22) Filed: May 23, 2000

Related U.S. Application Data

(63) Continuation-in-part of application No. 09/044,114, filed on Mar. 19, 1998.
(60) Provisional application No. 60/041,422, filed on Mar. 20, 1997.

(51) Int. Cl.[7] ..... F28D 15/00
(52) U.S. Cl. ..... 165/104.25; 165/104.23; 165/104.34; 165/109.1; 239/102.2; 239/102.1
(58) Field of Search ..... 165/104.21, 104.23, 165/104.25, 104.31, 104.33, 104.34, 109.1; 239/102.2, 102.1; 174/15

(56) References Cited

U.S. PATENT DOCUMENTS

| | | | | |
|---|---|---|---|---|
| 2,643,282 | | 6/1953 | Greene | 174/15 |
| 2,875,263 | | 2/1959 | Narbut | 174/15 |
| 3,042,481 | * | 7/1962 | Coggeshall | 165/109.1 |
| 3,729,138 | | 4/1973 | Tysk | 239/102 |
| 3,901,443 | | 8/1975 | Mitsui et al. | 239/102 |
| 3,957,107 | | 5/1976 | Altoz et al. | 165/32 |
| 4,043,507 | | 8/1977 | Wace | 239/102 |
| 4,350,838 | | 9/1982 | Harrold | 174/15 R |
| 4,406,323 | * | 9/1983 | Edelman | 165/109.1 |
| 4,572,285 | * | 2/1986 | Botts et al. | 165/104.28 |
| 4,605,167 | | 8/1986 | Maehara | 239/102 |
| 4,789,023 | | 12/1988 | Grant | 165/1 |
| 4,798,332 | | 1/1989 | Lierke et al. | 239/102.2 |
| 4,967,829 | * | 11/1990 | Albers et al. | 165/109.1 |
| 5,297,734 | | 3/1994 | Toda | 239/102.2 |
| 5,429,302 | | 7/1995 | Abbott | 239/102.2 |
| 5,518,179 | | 5/1996 | Humberstone et al. | 239/102.2 |
| 5,657,926 | | 8/1997 | Toda | 239/102.2 |

FOREIGN PATENT DOCUMENTS

| | | | |
|---|---|---|---|
| 4-83395 | 3/1992 | (JP) | H05K/7/20 |

OTHER PUBLICATIONS

Physical Review E: Viscous Effects In Droplet—Ejecting Cappillary Waves; C.L. Goodridge, et al.; 1997; pp. 472–475.
Solid–State Sensor and Actuators Workshop; Micromachined Acoustic–Wave Liquid Ejector; X. Zhu, etal.; Jun. 2, 1996–Jun. 6, 1996; pp. 280–282.
Annual Review of Fluid Mechanics, vol. 22; Paramtrically Forced Surface Waves; Jo Miles, et al.; 1990; pp. 143–163.
Physical Review Letters; Threshold Dynamics of Singular Gravity–Capillary Waves; C.L. Goodridge, et al.; Mar. 11, 1996; pp. 1824–1827.

* cited by examiner

*Primary Examiner*—James C. Yeung
*Assistant Examiner*—Terrell McKinnon
(74) *Attorney, Agent, or Firm*—Thomas, Kayden, Horstemeyer & Risley LLP

(57) ABSTRACT

A preferred embodiment of an atomizing apparatus incorporates a source of heat transfer fluid and an atomizing surface adapted to receive a droplet of the heat transfer fluid thereon. A driver also is provided which is configured to control a vibration of the atomizing surface at a frequency less than ultrasonic so that the atomizing surface forms a spray of atomized droplets from the droplet of the heat transfer fluid. Preferably, the vibration is configured to form, on the droplet, surface waves having a smaller wavelength than a diameter of the droplet, thereby ejecting and propelling the atomized droplets from the droplet. Methods also are provided.

17 Claims, 8 Drawing Sheets

VIBRATION INDUCED ATOMIZERS

CROSS-REFERENCE TO RELATED APPLICATIONS

This application is a Continuation-In-Part Application which is based upon and claims priority to U.S. patent application Ser. No. 09/044,114, filed on Mar. 19, 1998 (incorporated by reference herein in its entirety), which is based upon and claims priority to U.S. Provisional Application Ser. No. 60/041,422, filed Mar. 20, 1997 (incorporated by reference herein in its entirety).

BACKGROUND OF THE INVENTION

1. Field of the Invention

The present invention generally relates to vibration induced atomizers and, in particular, to vibration induced droplet and vapor atomizers that may be utilized in heat transfer applications, among others.

2. Description of the Related Art

Atomizers are commonly used in a variety of processes and devices. Atomizers, basically, are concerned with breaking up materials, typically liquids, into very small droplets, or particles. Designers of these devices have created a wide range of atomizing apparatuses and methods. For example, some atomizers collide a gaseous stream into a liquid stream to break the liquid stream into "atomized" droplets. Ultrasonic atomizers are also common. Ultrasonic atomizers utilize ultrasonic waves, typically in the megahertz frequency range, to atomize a liquid by focusing the ultrasonic waves on the free-surface of the liquid. In other applications, the ultrasonic vibrations are used to force liquid through an array of holes, each of the holes being on the order of tens of microns in size, to create a spray of atomized droplets. Additionally, other types of atomizers are well known in the art and used in a variety of applications.

Prior art atomizers, however, typically require some type of fluid piping and fluid supply to operate or use bulky ultrasonic transducers. Indeed, most atomizers are designed to constantly inject an atomized liquid into a system. An atomizer that does not require such fluid input to the system, but that is self-contained, may be very useful in many applications, such as in heat transfer devices. Additionally, an atomizer that combines rapid (even near instantaneous) atomization of a discrete fluid droplet will be advantageous in a wide variety of applications. Heat transfer is one potential application for such a new atomizer.

Thermal management is a critical technology for many of today's high performance devices. Particularly, thermal management is critical to high performance vehicles and engines as well as vehicles used in a microgravity environment, such space vehicles, satellites, and the like. In hypersonic flight, for example, the leading edge of an airfoil is subjected to intense frictional heating that can raise the temperature of the airfoil's skin to over the melting point. In advanced turbine engines, blade and vane cooling is critical to prevent melting, erosion, and/or structural failure of turbine blades and vanes. In a microgravity environment, spacecraft power plants are cooled properly for efficient operation. Similarly, the living environment of a spacecraft must be maintained within the proper temperature range. Sensitive scientific instruments used in space, such as low temperature charge coupled diode (CCD) imagers, are maintained at a constant uniform temperature in order to work effectively.

In addition, there is an ever-increasing demand for power in space missions, such as the Space Lab project. Increasing the size of power plants aboard such spacecraft brings with it an even larger thermal management problem associated with the waste heat generated by the system. Thus, effective cooling techniques are necessary in all of these applications.

One popular technique for thermal control in aerodynamic applications is film cooling. In this technique, air is injected from small holes in the surface of the object to be cooled to form a thin film of air flowing on the surface. The air film cools the surface and effectively insulates it from the high-temperature gas flowing past it.

Another popular technique for thermal management in these various applications is the use of a "heat pipe." These devices are often used in microgravity and aerodynamic applications because they can accommodate a wide range of operating temperatures, can transport large amounts of heat, and can operate independently of gravity. In addition, relatively high heat transfer rates can be achieved by heat pipes, which is typical of a phase-change heat transfer device.

Heat pipes are relatively simple devices. Conceptually, heat pipes passively transfer heat from a heat source to a heat sink, where the heat is dissipated. The heat pipe itself is a vacuum-tight vessel, typically cylindrical in shape, that houses a working fluid. The working fluid typically comprises methanol, ethanol, water, or another similar fluid. The vessel also houses a wick element spanning the length of the vessel. As heat is directed into one end of the heat pipe, the working fluid vaporizes, creating a pressure gradient along the length of the pipe. This pressure gradient forces the vapor to flow along the pipe to the cooler end, where the vapor condenses, giving up its latent heat of vaporization. The working fluid is then absorbed by the wick element and moved by capillary forces back to the heated end of the heat pipe.

While heat pipes have many advantages, heat pipes also have critical limitations. In aerodynamic applications, for example, the heat pipes must be capable of operating in the high g-loads typical of a maneuvering fighter aircraft. Regardless of the application, however, a major limitation of heat pipes is that the amount of heat transfer performed by these devices is strictly governed by the liquid flow rate produced by the capillary pumping in the wicking material of the heat pipe. Thus, there exists a need for improved apparatuses and methods which address these and other shortcomings of the prior art.

SUMMARY OF THE INVENTION

Briefly described, the present invention generally relates to vibration induced atomizers. In a preferred embodiment, an atomizing apparatus incorporates a source of heat transfer fluid and an atomizing surface adapted to receive a droplet of the heat transfer fluid thereon. A driver also is provided which is configured to control a vibration of the atomizing surface at a frequency less than ultrasonic so that the atomizing surface forms a spray of atomized droplets from the droplet of the heat transfer fluid. Preferably, the vibration is configured to form, on the droplet, surface waves having a smaller wavelength than a diameter of the droplet, thereby ejecting and propelling the atomized droplets from the droplet.

In another embodiment, an atomizing apparatus incorporates a source of heat transfer fluid and a means for controlling a vibration of a droplet of the heat transfer fluid at a frequency less than ultrasonic so that a spray of atomized droplets is formed from the droplet of the heat transfer fluid.

Other embodiments may be construed as providing a method for transferring heat from a heated body. In a preferred embodiment, the method includes the steps of: providing a chamber having a first wall and a second wall spaced therefrom, the chamber containing a heat transfer fluid; arranging at least a portion of the first wall in a heat transfer relationship with the heated body, the heated body being located externally of the chamber; placing a discrete quantity of the heat transfer fluid into contact with the second wall; and vibrating the second wall at a frequency less than ultrasonic to disintegrate the liquid droplets into smaller secondary droplets. Preferably, the secondary droplets are propelled away from the second wall by its vibration so that at least some of the secondary droplets impact an interior of the first wall and vaporize, thereby transferring heat from the first wall.

Other features and advantages of the present invention will become apparent to one with skill in the art upon examination of the following drawings and detailed description. It is intended that all such features and advantages be included herein within the scope of the present invention, as defined in the appended claims.

BRIEF DESCRIPTION OF THE SEVERAL VIEWS OF THE DRAWINGS

The accompanying drawings, which are incorporated herein, and form a part of the specification, illustrate the preferred embodiments of the present invention and, taken together with the description, serve to illustrate and explain the principles of the present invention. As such, the drawings are not necessarily drawn to scale, emphasis instead being placed on clearly illustrating the principles of the invention. In the drawings.

DETAILED DESCRIPTION OF THE PREFERRED EMBODIMENTS

Figure 1:
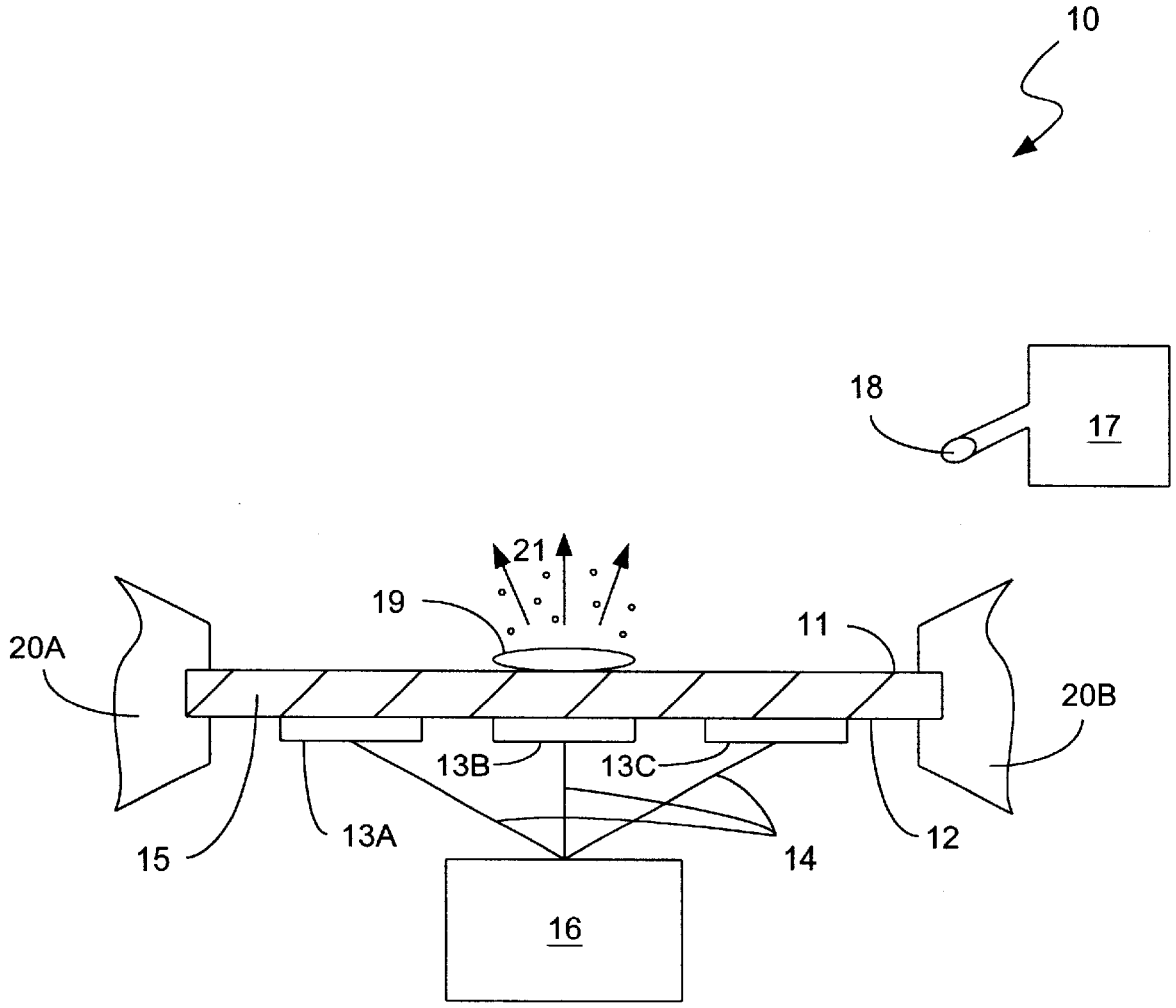
FIG. 1 depicts a schematic side view of a preferred embodiment of a basic vibration induced droplet atomizer.

Referring now to the drawings, wherein like reference numerals designate corresponding parts throughout the several views, a preferred embodiment of a vibration induced droplet atomizer and two preferred embodiments of heat transfer cells using the atomizers will be described. As described in detail hereinafter, a vibration-induced droplet atomizer of the present invention preferably incorporates a flexible membrane mounted rigidly about its periphery. A thin layer of piezo-ceramic material is adhered to the underside of the membrane and time-varying voltage with an arbitrary amplitude and frequency is applied to the piezo-ceramic causing it to expand and contract. This motion causes the membrane to move vertically up and down in response to the applied voltage and creates an atomization of liquid residing upon the membrane. (It should be noted that this is not ultrasonic atomization because the present invention operates at lower frequencies; the spray that is created produces droplets that typically are an order of magnitude larger than those of ultrasonic atomizers and with much larger velocities.)

For instance, a centimeter-sized droplet of some arbitrary liquid, e.g., water, is placed on the membrane, such as at the center of the top surface of the membrane, by any suitable method. The piezo-ceramic is then energized with a sinusoidal voltage and a given time-varying amplitude with a frequency of hundreds to thousands of Hertz. The membrane starts to move up and down producing waves on the surface of the droplet. If the correct frequency and amplitude are used, the surface waves will have a much smaller wavelength than the original droplet diameter and they will begin to eject a smaller droplet or droplets from each wave crest on each upward stroke. If the amplitude is large enough, the entire volume of the original droplet can be converted into the smaller droplets within a fraction of a second. The process looks like a bursting phenomena, thus, we also call this droplet bursting.

At a frequency of about 1 kHz, the ejected droplet size is about 400 microns and droplets move away from the membrane at velocities of several meters per second. Therefore, it is not necessary to have an external method (e.g., a fan, an air jet, etc.) to transport the droplets away from the atomization site to where they are needed, e.g., for evaporation. To do this successfully, the membrane is moving up and down at about 200 microns peak to peak. This produces an acceleration of about 400 g's at the surface of the membrane. The membrane used in one embodiment of the present invention is a thin steel plate about 1 inch in diameter. The power used to create this atomization is on the order of a fraction of a watt. Thus, the atomizing transducer is small, lightweight, and requires very little power to function properly. The droplet size and velocity produced by this process are also ideal for spraying. This process can successfully spray a thin layer of liquid onto a hot surface and, thus, effectively cool the surface by evaporation. This is the reason why the present invention is described hereinafter in relation to a heat transfer cell, although various other applications are contemplated, and are considered well within the scope of the present invention.

A. The Vibration Induced Droplet Atomizer

FIG. 1 depicts a preferred embodiment of a vibration induced atomizer 10. The atomizer 10 preferably incorporates a diaphragm 15 which includes an atomizing surface 11. The diaphragm 15 is attached at each of its ends to supports 20*a*, 20*b*. The diaphragm 15 may be attached by devices such as rivets, bolts, screws, or any other device for suitably securing the diaphragm 15. The particular attachment means used, as well as the particular design of the supports 20*a*, 20*b*, will depend largely on where the atomizer 10 will be used and/or mounted.

A first side 12 of the diaphragm 15 is affixed with a device capable of creating an oscillation of the atomizing surface 11. Preferably, the oscillation creating device incorporates an array of piezoelectric actuators 13*a*–13*c*. These actuators 13*a*–13*c* are attached to the diaphragm 15 with an adhesive, such as glue, or other appropriate means. Further, the piezoelectric actuators 13*a*–13*c* are connected, via wiring 14, to a driver 16. The driver 16 may include a wave generator, microcomputer, or other controllable voltage source. The atomizer 10 also incorporates a fluid source 17 with a dispenser 18. The source 17 and dispenser 18 may be configured as a syringe, a fluid injector, or other device capable of dispensing a measured fluid droplet 19 onto the atomizing surface 11. A basic schematic of an injector 18 is depicted in FIG. 1.

In operation, the driver 16 causes the piezoelectric actuators 13*a*–13*c* to vibrate. The vibration of the actuators 13*a*–13*c* creates normal oscillation of the atomizing surface 11. As the atomizing surface 11 oscillates, the source 17 and dispenser 18 place a metered fluid droplet 19 onto the atomizing surface 11. The size of the droplet 19 is a matter of choice depending on the application where the atomizer 10 is utilized.

Once the fluid droplet 19 comes in contact with the atomizing surface 11, the oscillation of the surface 11 creates waves in the droplet 19. If the frequency and amplitude of the atomizing surface 11 oscillation is tailored to a value corresponding to the resonant frequency for the size of the droplet 19, then an instability of the liquid-gas interface occurs due to disturbances at the vibrational frequency of the atomizing surface 11. The instability manifests itself as a set of nonlinear surface waves that rapidly grow in amplitude with a time constant that is primarily affected by the excitation amplitude and the surface tension at the interface. When the wave amplitude is of the order of the drop height, the droplet 19 breaks up and is completely drained into a spray of smaller (between one and two orders of magnitude) secondary droplets 21 that are directed away from the surface 11. The spray velocity near the atomizing surface 11 appears to depend on the vibrational energy of the primary droplet 19 prior to its breakup.

The relationship between the proper amplitude and frequency of vibration and the droplet size can be determined without undue experimentation by one skilled in the art, with droplet size being determined based upon the requirements of the particular application. For example, it is known that a water droplet having a planform diameter of approximately 5 mm will break apart when the atomizing surface 11 is operated at a frequency of approximately 1000 Hz and an amplitude of less than 100 $\mu$m. The resonant frequency increases with diminishing droplet size. Thus, one with ordinary skill in the art will be able to determine the appropriate frequency for a desired droplet size.

As alternatives to the atomizer 10 depicted in FIG. 1, the source 17 and dispenser 18 may be provided in other embodiments. For example, the droplets could be received into orifices in the diaphragm 15. If this were the case, the preferred dispenser 18 may incorporate a tube for draining fluid from the source 17 to the orifice in the diaphragm 15. The flow of fluid through the tube could be regulated such that discrete portions of fluid are deposited into the orifices. Typically, the flow regulator is an electronically controlled valve along the tubing.

Of course the "source" may include the environment in which the atomizer operates and the "dispenser" may include a natural phenomenon such as condensation or boiling. The preferred applications described below use these types of "sources" and "dispensers" for the basic atomizer 10 described above. Applications for such an atomizer may include fuel atomization, biomedical applications, dispersion of a liquid into another liquid, heat transfer, or many other applications. A preferred application for the atomizer 10 described above is in the construction of heat transfer cells. This preferred application will now be described in detail below.

B. Heat Transfer Cell Using A Vibration Induced Droplet Atomizer

1. First Preferred Embodiment

Figure 2:
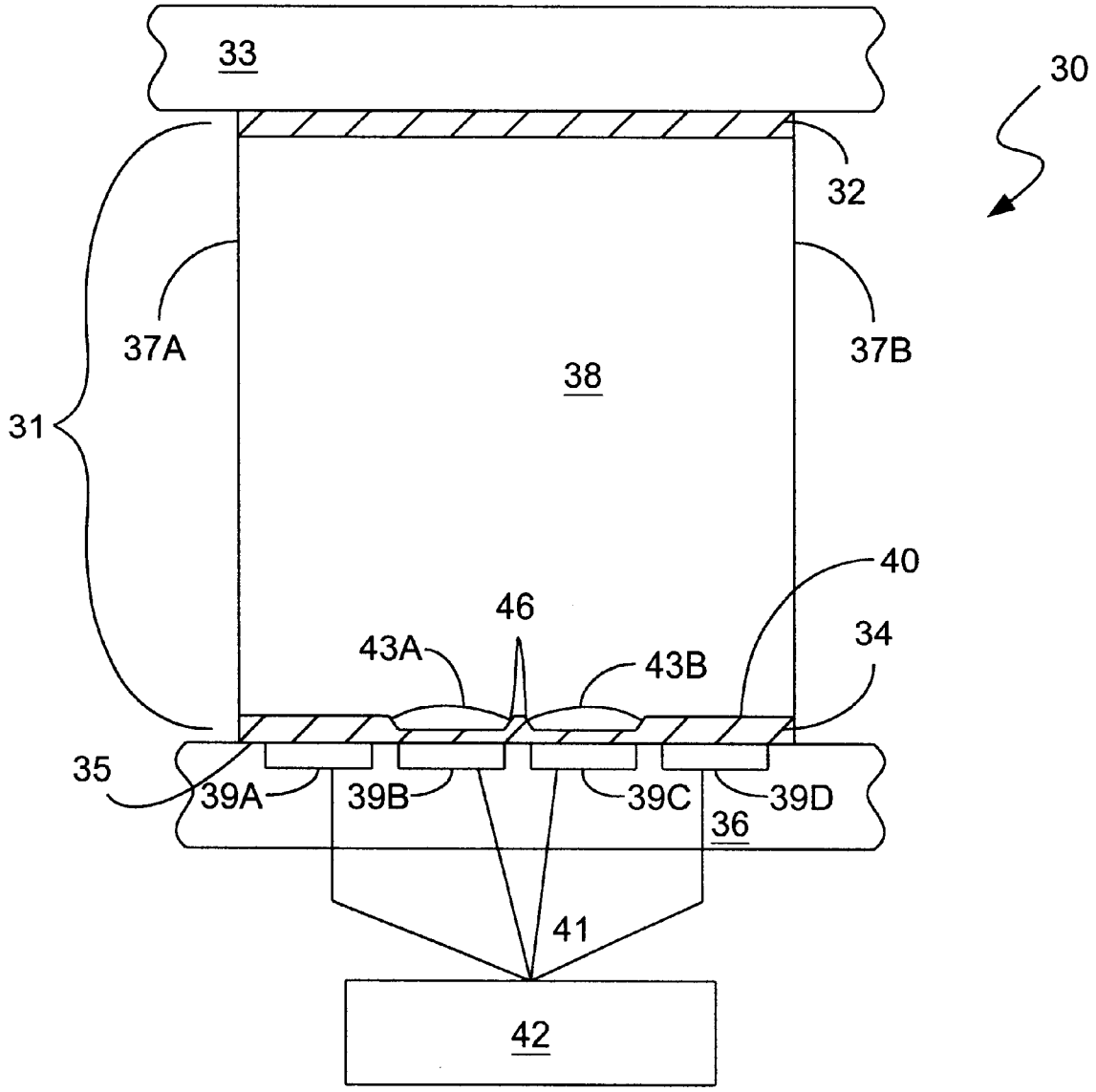
FIG. 2 depicts a schematic side view of a preferred embodiment of a heat transfer cell.

FIG. 2 depicts a heat transfer cell 30 of a first preferred embodiment of the present invention. This first preferred embodiment 30 incorporates a chamber 31. This chamber 31 can be of many different shapes, however, the preferred embodiment 30 includes a chamber 31 shaped as a cylinder, such as with a rectangular cross-section, for example, although various other configurations may be utilized. Preferably, the chamber is sealed, although other embodiments may not be not so-limited.

A first wall 32 of the chamber 31 is preferably attached to a hot surface or heat-producing body 33. Alternatively, this first wall 32 may be a part of the heat-producing body itself. Preferably, this first, heated wall 32 is the wall forming a first end of the cylindrical chamber 31. A second wall 34 of the chamber 31 is attached to a cool surface or cooling device 36. The cooling device 36 may incorporate such items as a radiator, a fan or other heat transfer device. The selection of a proper cooling device 36 depends on the particular environment in which the heat cell 30 will be used. The cool wall 34 is preferably the wall forming a second end of the cylindrical chamber 31. In this way, the heated wall 32 and the cool wall 34 directly oppose one another. Lateral walls 37*a*, 37*b* of the chamber 31 connect the two opposing end walls 32, 34 and form the remainder of the chamber 31. Note that the other two lateral walls forming this chamber 31 are not depicted in FIG. 2.

The chamber 31 of the first preferred embodiment 30 is filled with a fluid 38 in a gaseous phase. This gas 38 can be of any appropriate type for heat transfer applications but, preferably, the gas 38 comprises water vapor.

An array of piezoelectric disks 39*a*–39*d* are attached to an exterior surface 35 of the second, cool wall 34 of the chamber 31. The piezoelectric disks 39 may be attached by glue or other appropriate means understood in the art. The piezoelectric disks 39 are attached via wiring 41 to a driver 42. This driver 42 causes the piezoelectric disks 39*a*–39*d* to vibrate at a specific frequency and amplitude. The driver 42 may be of any appropriate type of voltage generating device, but preferably the driver 42 is a wave generator that can be controlled for voltage output. The driver 42 may incorporate a computer, or other logic circuitry, capable of voltage output to the piezoelectric disks 39*a*–39*d*. As the piezoelectric disks 39*a*–39*d* are caused to vibrate by the driver 42, the second end wall 34 moves in periodic motion normal to the exterior surface 35 of the second wall 34.

Although not a requirement of the preferred embodiment of the present invention, the second, cooled wall 34 of the chamber 31 may be outfitted with specifically constructed condensation sites 46 aligned with the piezoelectric disks 39*a*–39*d*. Such sites 46 are typically constructed as recesses on an interior surface 40 of the second wall 34 of the chamber 31. As the temperature of the gas 38 rises, the gas 38 will begin to condense along the interior surface 40 of the cool wall 34 at the specifically constructed condensation sites 46. As a result, condensation droplets 43*a*, 43*b*, form along the surface 40 and begin to grow.

In some applications, it may not be desirable that the gas 38 condenses along the lateral walls 37*a*, 37*b* of the chamber 31. To this end, the lateral walls 37*a*, 37*b* can be insulated, or even slightly heated, in order to prevent condensation along the interior surfaces of these walls 37*a*, 37*b*. However, in other applications, the gas may be allowed to condense along the lateral walls, whereby the condensate may merely be gravity fed down the walls and to the surface 40.

Figure 3:
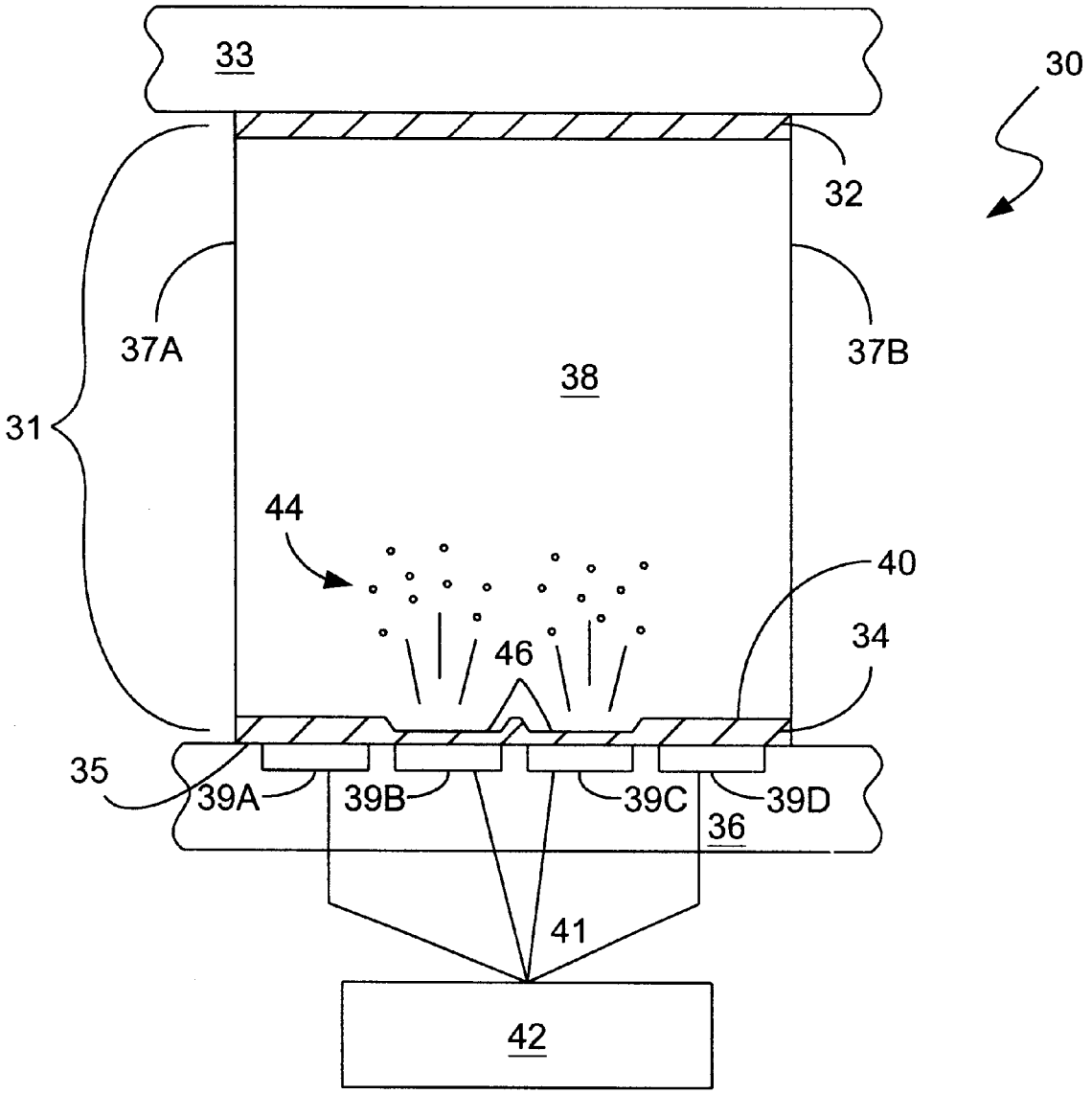
FIG. 3 depicts the heat transfer cell of FIG. 2 where the liquid droplets have shattered into smaller secondary droplets.

The response of the liquid droplets 43*a*, 43*b* to the normally vibrating second end wall 34 is initially no more than solid-body vibration along with the second wall 34. Through the natural process of condensation along the cool interior surface 40 of the second end wall 34, the liquid droplets 43*a*, 43*b* begin to grow in size. When these droplets 43 reach a critical size, the free surface instability produced by the vibration of the piezoelectric disks 39*a*–39*d* causes the droplets 43 to produce waves. If the amplitude of the oscillation of the wall 34 is large enough, the droplets 43 will disintegrate into a spray of smaller, secondary droplets 44, as depicted in FIG. 3. The secondary droplets 44 are propelled away from the cool interior surface 40 of the second wall 34 and across the chamber 31.

Figure 4:
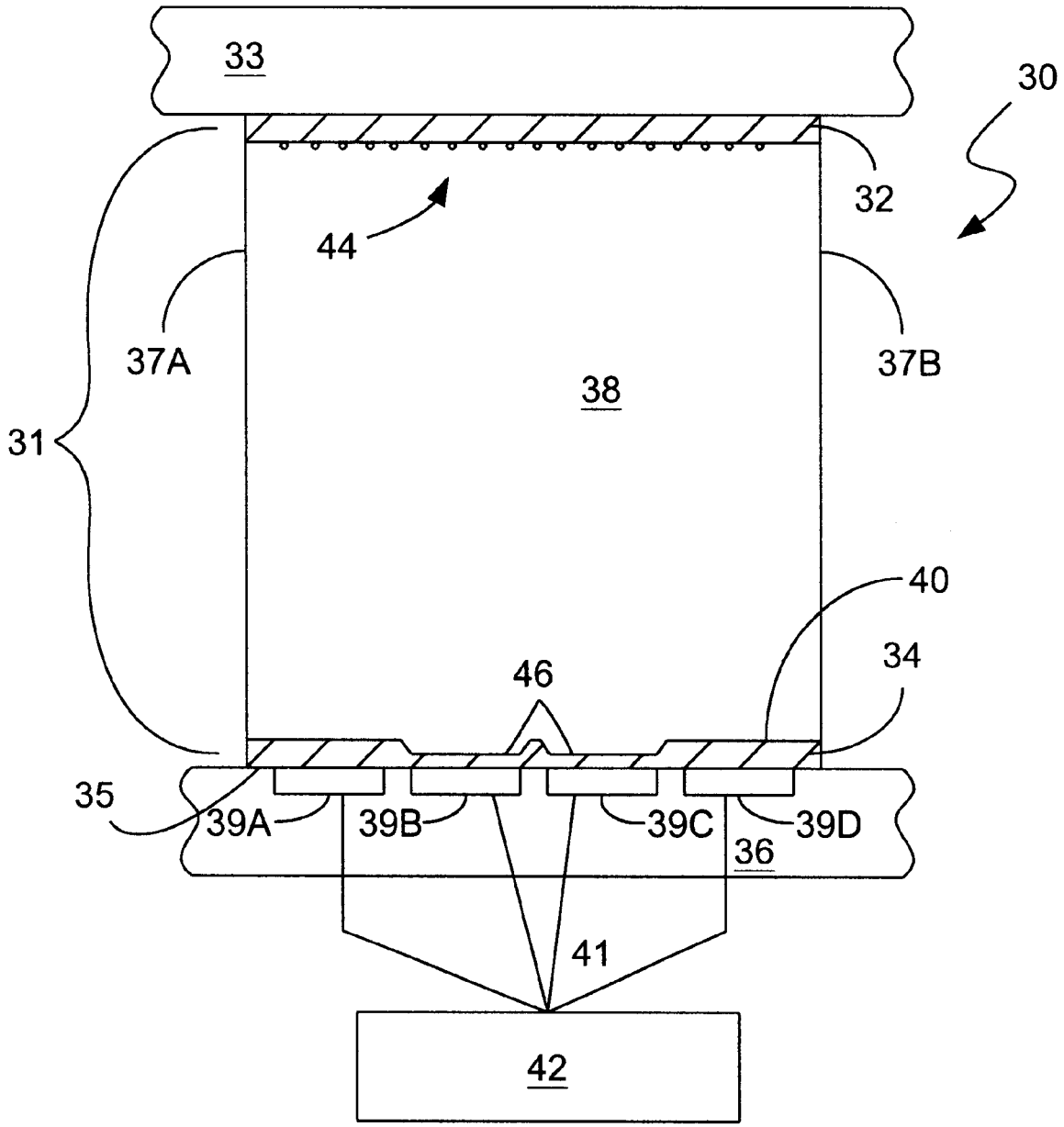
FIG. 4 depicts the heat transfer cell of FIG. 2 after the secondary droplets have impacted a heated surface of the cell chamber.

As depicted in FIG. 4, the secondary liquid droplets 44 impact the chamber wall opposite to the second end wall 34, the heated surface, or first end wall 32. Upon impact, these droplets 44 spread out and are vaporized. This evaporation process transfers heat from the first heated end wall 32 into the vapor 38. The evaporation of the droplets 44 produces a large vapor pressure in the vicinity of the heated first end wall 32. This increased vapor pressure forces the vapor 38 away from the first end 32 of the chamber 31 and toward the cool end wall 34 of the chamber 31. As outlined above, as the vapor contacts the cool interior surface 40 of the second end wall 34, the vapor 38 condenses to form the liquid condensate droplets 43 used to create the spray of secondary droplets 44. Thus, the cycle will continue to transfer heat away from the heated first end wall 32 to the second end wall 34 of the first preferred embodiment 30. If the liquid droplets 43 are continually replaced by condensing gas, then the spray of secondary droplets 44 will be nearly continuous.

2. Second Preferred Embodiment

Figure 5:
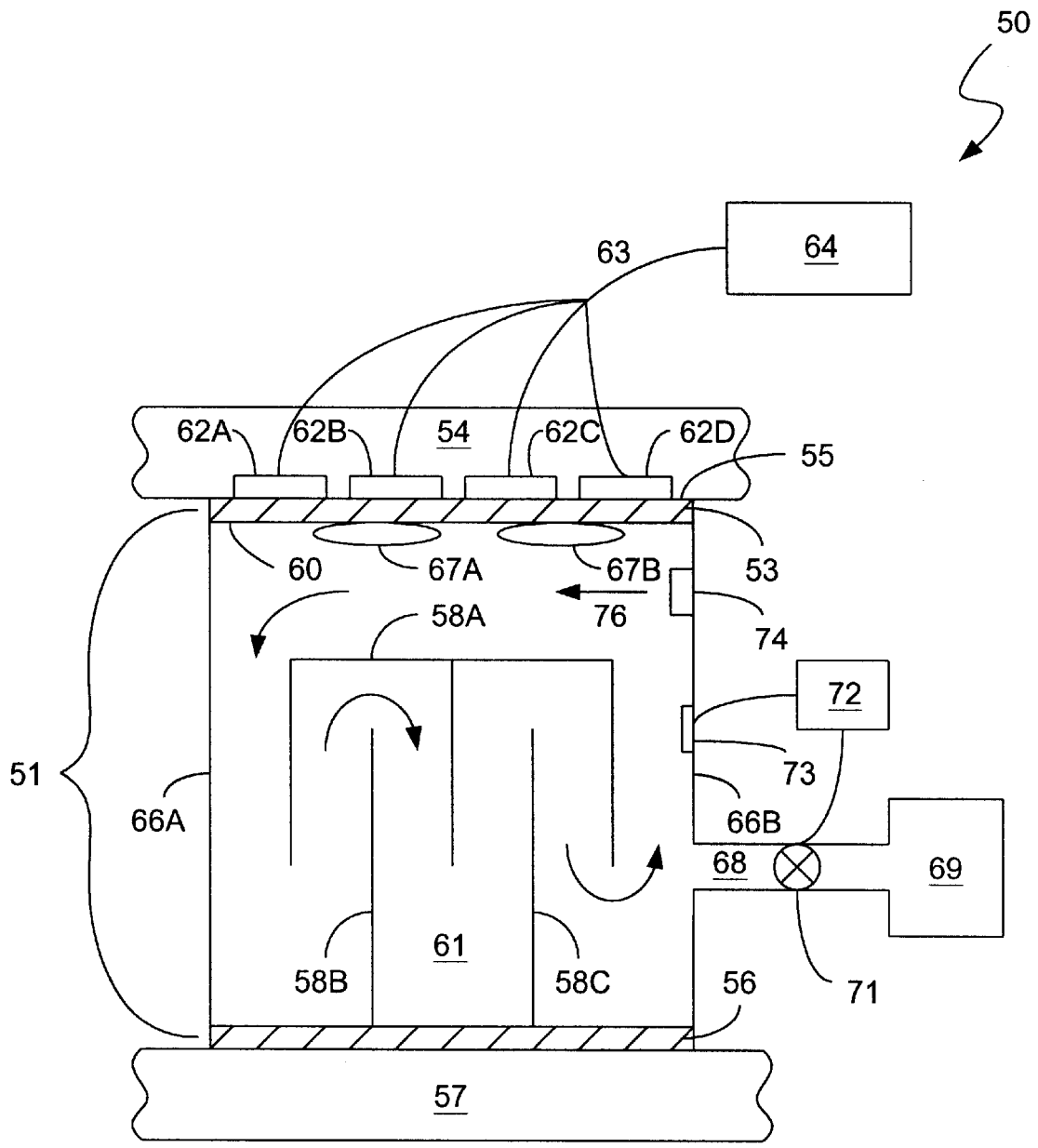
FIG. 5 depicts a schematic side view of an alternative embodiment of a heat transfer cell.

A second preferred embodiment 50 of a heat transfer device using a vibration induced atomizer of the present invention is depicted in FIG. 5. The second preferred embodiment 50 generally includes a heat transfer cell based on nucleate boiling technology implemented with a vibration induced atomizer. The present embodiment of heat transfer cell 50 incorporates a chamber 51 with walls. Although many different shapes of chambers may be used with the second preferred embodiment 50, a cylindrical chamber 51 with a rectangular cross-section has been selected. As such, the chamber is defined by a first end wall 53 and a second end wall 56 directly opposing this first end wall 53. The chamber also has four lateral walls 66*a*, 66*b* (only two lateral walls are depicted) connecting the first and second end walls 53, 56.

The chamber 51 of the second preferred embodiment 50 is preferably sealed from an outside environment 52; however, a sealed chamber is not required. The entire chamber 51, whether sealed or not, is filled with a working fluid 61 principally in a liquid phase. This fluid may include fluids such as water, methanol, ethanol, or refrigerants. The present invention is not limited to the use of any particular fluid, although water is the preferred heat transfer liquid.

The first end wall 53 of chamber 51 is attached to a heat-producing body or surface 54. Alternatively, first end wall 53 could be merely placed directly adjacent to the heated body (or device) 54, or the end wall 53 could incorporate the heated itself. This first end wall 53 is preferably one of the end walls of the cylindrical chamber 51. As mentioned above, a second end wall 56 directly opposes the first end wall 53. This second wall 56 is preferably connected to a cooled surface or cooling device 57. As above, the cooling device 57 may include such items as a radiator, fan or other heat transfer device. The selection of a proper cooling device 57 depends on the particular environment in which the heat cell 50 will be used.

Interior to the chamber 51, there are preferably a series of heat exchange surfaces or fins 58*a*–58*c*. These heat exchange fins 58*a*–58*c* are preferably connected to the second end wall 56 and cooled thereby. A typical arrangement of these fins 58*a*–58*c* is depicted FIG. 5; although other arrangements of fins 58*a*–58*c* are contemplated. The goal in arranging fins 58*a*–58*c* is usually to permit circulation of the fluid 61 throughout the chamber 51, while exposing a great amount of surface area to the working fluid 61. Although fins 58*a*–58*c* are not necessary, these fins 58*a*–58*c* provide increased surface area for heat exchange and a generally more efficient heat transfer cell 50.

On an exterior surface 55 of the first end wall 53, there are preferably attached an array of piezoelectric disks or elements 62*a*–62*d*. These piezoelectric elements 62 can be attached by glue or any other appropriate adhesive. The piezoelectric array 62 is connected by wiring 63 to a driver 64. The driver 64 drives the piezoelectric disks 62 such that the first wall 53 is vibrated at a given frequency and amplitude and caused to oscillate normal to its surface 55. The driver 64 may incorporate any controlled/controllable source of voltage, such as a generator or computer.

Although not required by the preferred embodiment 50, the lateral walls 66*a*, 66*b* may be insulated. This improvement may improve the performance of the heat transfer cell in certain applications.

As the first wall 53 begins to heat up, heat is transferred to the liquid 61 adjacent to an interior surface 60 of the first end wall 53. Eventually the liquid 61 will begin to boil. Boiling produces vapor bubbles 67*a*, 67*b* attached to the interior surface 60 of the first end wall 53. These vapor bubbles 67*a*, 67*b* increase in size as the temperature of the liquid 61 increases and boiling continues.

As the boiling liquid may alter the pressure of the liquid 61 in the chamber, it is desirable that a primary chamber 51 be connected through a series of fluidic piping 68 to an auxiliary chamber 69 where reserve fluid may be stored in order to keep the pressure inside the primary chamber 51 equal. The flow of fluid between the chamber 51 and the reserve chamber 69 is typically controlled by a computer-operated valve 71. Of course, other logic circuitry will function equally well to a computer control system 72. The control system 72 will preferably receive pressure data on the interior pressure of the primary chamber 51 from a pressure sensor 73. As the pressure changes in the chamber 51, the control system 72 alters the flow of fluid through the valve 71 to keep the pressure in the chamber 51 at a pre-selected value.

Along one of the lateral walls 66*b* of the second preferred embodiment 50, there is positioned a synthetic jet actuator 74. Generally, a synthetic jet actuator incorporates a housing defining an internal chamber. An orifice, or opening, is defined by a wall of the housing. The synthetic jet actuator further includes a mechanism in or about the housing for periodically changing the volume within the internal chamber. As the volume of the synthetic jet chamber is decreased, a series of fluid vortices are generated at the orifice and projected into the chamber. These vortices move away from the edges of the orifice under their own self-induced velocity and synthesize a jet of fluid through entrainment of the chamber liquid 61. As the volume of the synthetic jet chamber is increased, fluid 61 is drawn from the orifice into the synthetic jet chamber. Since the vortices are already removed from the edges of the orifice, they are not affected by the fluid 61 being entrained into the synthetic jet chamber. In operation, the synthetic jet actuator creates a jet of fluid without creating any net mass change in the heat cell chamber 51.

Synthetic jet actuators are fully described in, among others, copending patent application No. 08/489,490, filed Jun. 12, 1995. This application is hereby incorporated by reference as if fully set forth herein. The synthetic jet actuator 74 used in the present invention creates a fluid flow (or current), depicted by arrow 76, across the heated wall 53 of the chamber 51.

Figure 6:
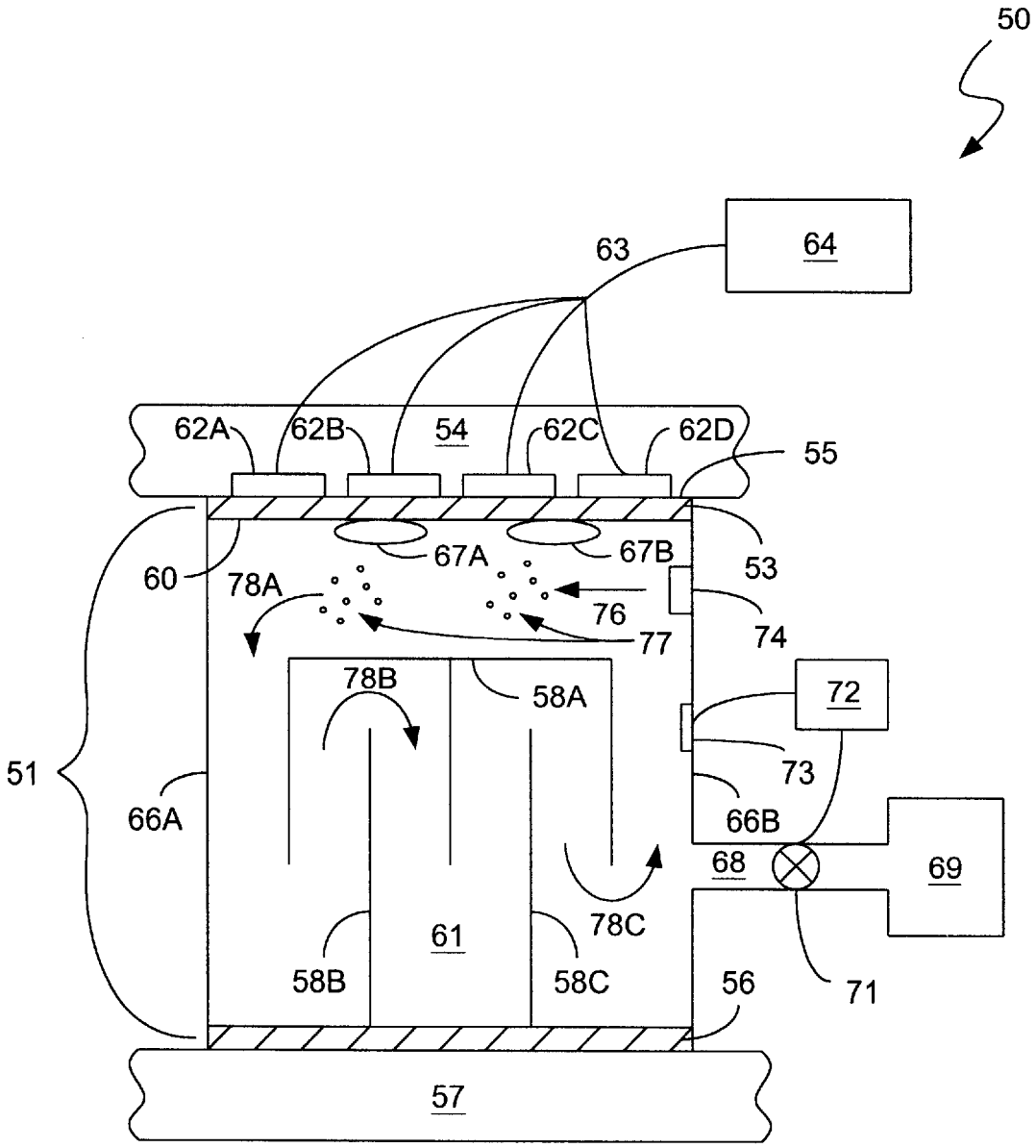
FIG. 6 depicts the heat transfer cell of FIG. 5 where the vapor bubbles have been shattered into smaller vapor bubbles.

As mentioned above, as the heat transfer to the liquid 61 increases, the vapor bubbles 67 continue to grow in size. When the vapor bubbles 67 reach a critical size related to the vibration frequency of the piezoelectric disks 62, the free-surface instability produced by the vibration will produce waves on the vapor bubbles and, for large enough vibration amplitudes, generate a cloud of smaller, secondary bubbles 77 from the vapor bubbles 67. The larger vapor bubbles 67*a*, 67*b* are usually not completely disintegrated into the secondary bubbles 77 and are typically still in contact but are released from the grip of contact-angle hysteresis with the interior surface 60 of the first end wall 53. See FIG. 6. The synthetic jet 74 not only creates a flow 76 of fluid, or current, across the interior surface 60 of the first wall 53, but this flow 76 circulates throughout the chamber 51 such that the fluid 61 is exposed to all the surfaces of the fins 58. The flow of the fluid is depicted in FIG. 6 by the arrows 78*a*–78*c*.

Figure 7:
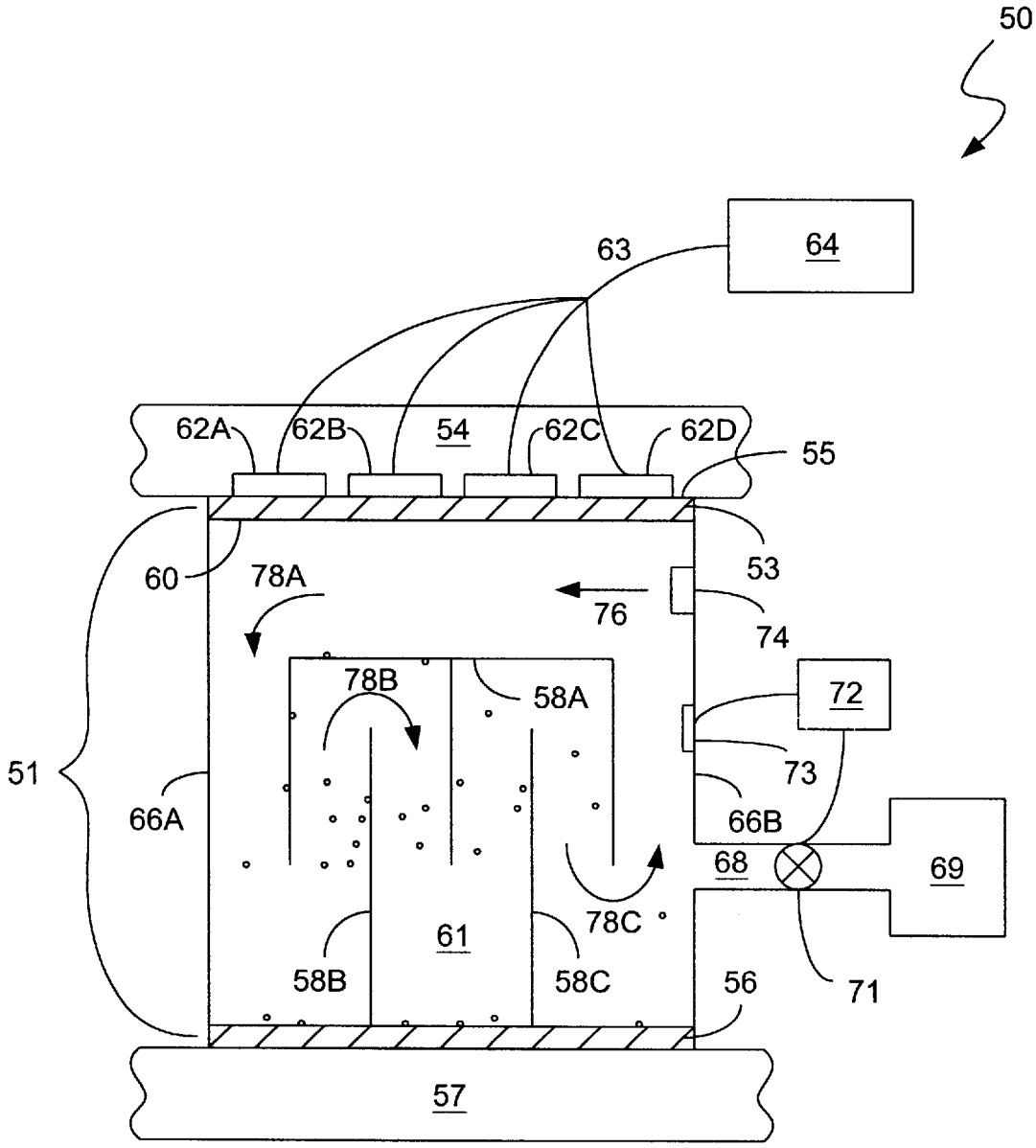
FIG. 7 depicts the heat transfer cell of FIG. 5 where the smaller vapor bubbles are circulated throughout the cell chamber.

A unique characteristic of the synthetic jet 74 is the very strong entrainment of fluid 61 into its flow 76. As such, the flow 76 will entrain both the tiny vapor bubbles 77 and the larger vapor bubbles 67. The flow 76 will carry these bubbles 67, 77 away from the interior surface 60 of the first end wall 53. Because of the strong entrainment by the jet 74, the working fluid 61 with the bubbles 67, 77, will be circulated through the cooled conducting partitions or fins 58 attached to the cold surface 56 in order to improve the transfer performance of the cell 51. See FIG. 7. At the fins 58, or at the cooled surface 56, the bubbles 67, 77 will condense back into a liquid phase and complete the heat transfer cycle in the cell 50.

Figure 8:
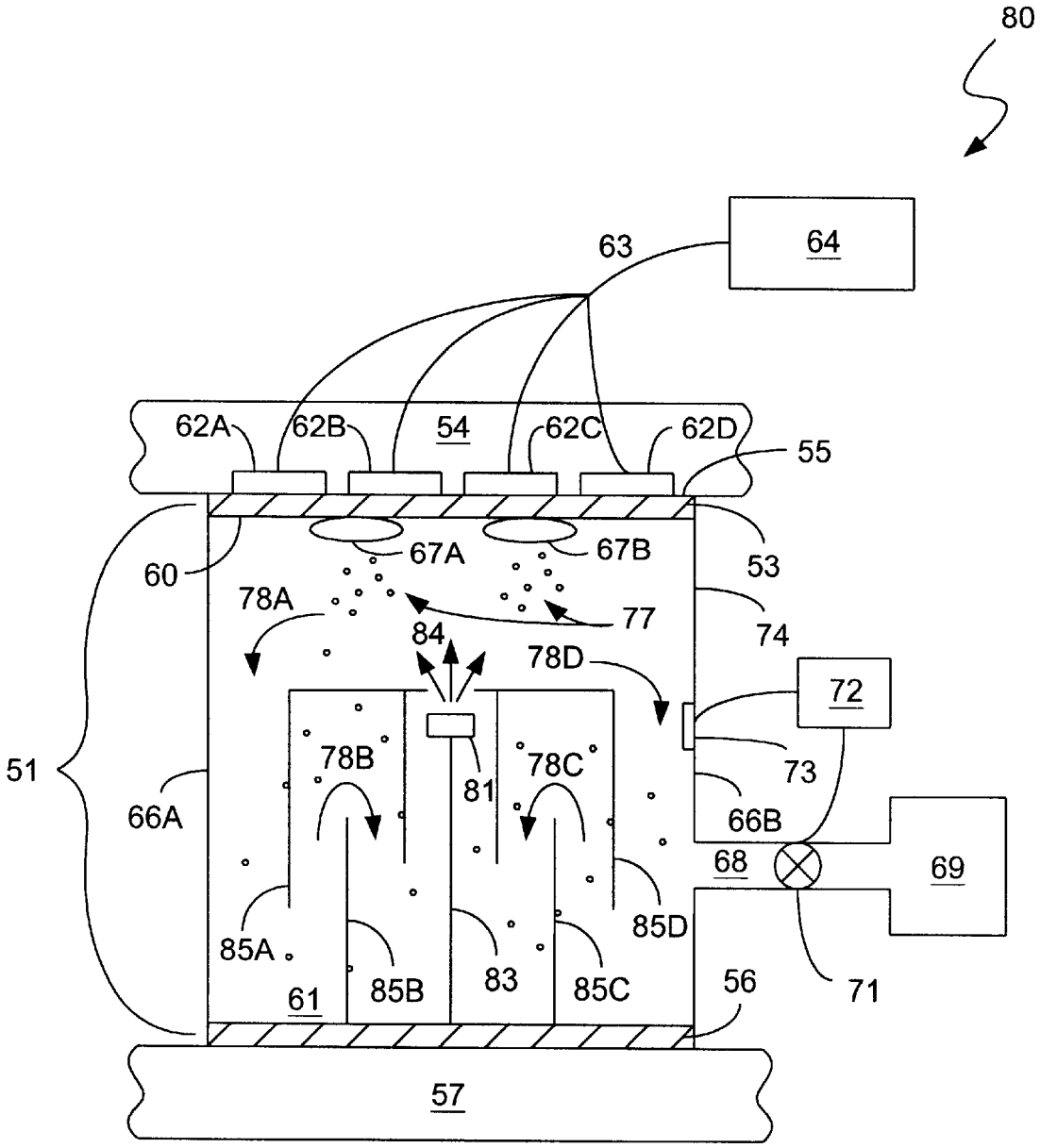
FIG. 8 depicts a schematic side view of an alternative embodiment of a heat transfer cell.

A modification of the second preferred embodiment 80 is depicted in FIG. 8. This modification 80 includes a chamber 51 with walls. As above, the chamber 51 incorporates a first end wall 53 and a second end wall 56 directly opposing this first end wall 53. The chamber also includes four lateral walls 66*a*, 66*b* (only two depicted) connecting the first and second end walls 53, 56. As described above, the chamber 51 is filled with a heat transfer liquid 61. The first end wall 53 of this chamber 51 is attached to a heat-producing body or heated surface 54. The second wall 56 is preferably connected to a cooling device or cooled surface 57.

On an exterior surface 55 of the first end wall 53, there is preferably attached an array of piezoelectric disks or elements 62*a*–62*d*. The driver 64 drives the piezoelectric disks 62 such that the first wall 53 is vibrated at a given frequency and amplitude and caused to oscillate normal to its surface 55.

As the first wall 53 begins to heat up, heat is transferred to the liquid 61 adjacent to the interior surface 60 of the first end wall 53. Eventually, the liquid 61 will begin to boil. Boiling produces vapor bubbles 67*a* and 67*b* attached to the interior surface 60 of the first end wall 53. These vapor bubbles 67*a*, 67*b* increase in size as the temperature of the liquid 61 increases and boiling continues.

When the vapor bubbles 67 reach a critical size related to the vibration frequency of the piezoelectric disks 62, the free-surface instability produced by the vibration will produce waves on the vapor bubbles and, for large enough vibration amplitudes, generate a cloud of smaller, secondary bubbles 77 and release the larger vapor bubbles 67*a*, 67*b* from the grip of contact-angle hysteresis on the interior surface 60 of the first end wall 53.

A synthetic jet actuator 81 is located at the center of the cell chamber 82 and attached to a heat sink fin 83. The heat exchange fins 83, 86*a*–86*d* are preferably connected to the second end wall 56. These fins 83, 86*a*–86*d* permit circulation of the fluid throughout the chamber 51, while exposing a great amount of surface area to the working fluid 61.

The synthetic jet actuator 81 is driven such that a fluid jet 84 will time-periodically sweep across the heated surface 60, thus providing a localized momentary stagnation point flow which may improve the performance of the cell 80 in certain applications. As above, the synthetic jet actuator creates a flow 84 of fluid that circulates throughout the chamber 51 such that the fluid 61 is exposed to all the surfaces of the fins 83, 86*a*–86*d*. The flow of the fluid is depicted in FIG. 8 by the arrows 78*a*–78*d*.

As described above, the synthetic jet flow 84 will entrain both the tiny vapor 77 and the larger vapor bubbles 67. The flow 84 will carry these bubbles 67, 77 from the interior surface 60 of the first end wall 53. Because of the strong entrainment by the jet 84, the working fluid 61 with the bubbles 67, 77, will be circulated through the cooled conducting partitions or fins 83, 86*a*–86*d* attached to the cold surface 56 in order to improve the heat transfer performance of the cell 51. Near the fins 83, 86*a*–86*d*, or near the cooled surface 56, the bubbles 67, 77 will condense back into a liquid phase and complete the heat transfer cycle in the cell 80.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

What is claimed is:

1. A method of transferring heat from a heated body, comprising the steps of:

providing a chamber having a first wall and a second wall spaced therefrom, the chamber containing a heat transfer fluid;

arranging at least a portion of the first wall in a heat transfer relationship with the heated body, the heated body being located externally of the chamber;

placing a discrete quantity of the heat transfer fluid into contact with the second wall; and vibrating the second wall at a frequency less than ultrasonic to disintegrate the liquid droplets into smaller secondary droplets.

2. The method of claim 1, further comprising the step of:

propelling the secondary droplets away from the second wall such that at least some of the secondary droplets impact an interior of the first wall and vaporize, thereby transferring heat from the first wall.

3. The method of claim 1, further comprising the step of:

condensing the heat transfer fluid through heat transfer to the second wall, wherein the heat transfer fluid condenses and forms liquid droplets along an interior of the second wall.

4. The method of claim 1, further comprising the step of:

dispensing the discrete quantity of the heat transfer fluid onto the atomizing surface.

5. The method of claim 1, further comprising the step of:

cooling the second wall of the chamber.

6. The method of claim 1, wherein the step of vibrating the second wall comprises the step of:

vibrating the second wall to form, on the liquid droplets, surface waves having a smaller wavelength than a diameter of the liquid droplets.

7. The method of claim 1, wherein the step of vibrating the second wall comprises the step of:

utilizing power of less than 1 Watt to vibrate the second wall.

8. The method of claim 2, wherein the heat transfer fluid is water, and wherein the step of propelling the secondary droplets comprises the step of:

imparting a velocity of at least 1 m/s to at least some of the secondary droplets.

9. An atomizing apparatus comprising:

a source of heat transfer fluid;

a sealed chamber having a first wall, a second wall and at least one side wall extending therebetween, said first wall having an exterior surface and an interior surface, said exterior surface being configured to engage a heated surface, the heated surface being arranged externally of said sealed chamber, said interior surface being arranged inside said sealed chamber, said first wall being configured to conduct heat from the heated surface and transfer at least a portion of the heat to said interior surface, said first wall opposing said second wall, said second wall having an exterior surface and an interior surface arranged inside said sealed chamber, said interior surface of said second wall being a cool surface relative to the heated surface and being adapted to receive a droplet of said heat transfer fluid;

a driver configured to control a vibration of said interior surface of said second wall at a frequency less than ultrasonic such that said atomizing surface forms a spray of atomized droplets from said droplet of said heat transfer fluid, the vibration being configured to form, on said droplet, surface waves having a smaller wavelength than a diameter of said droplet, thereby ejecting and propelling said atomized droplets from said droplet.

10. The atomizing apparatus of claim 9, further comprising:

a dispenser in fluid communication with said source of heat transfer fluid, said dispenser being configured to dispense a droplet of said heat transfer fluid on said interior surface of said second wall.

11. The atomizing apparatus of claim 9, further comprising:

a piezoelectric element engaging said second wall and electrically communicating with said driver such that said piezoelectric element vibrates said interior surface of said second wall in response to said driver.

12. The atomizing apparatus of claim 9, wherein said exterior surface of said second wall is configured to engage a cooling device, said cooling device being configured to maintain said cool surface at a temperature cooler than a temperature of said interior surface of said first wall.

13. The atomizing apparatus of claim 9, wherein said at least one side wall is insulated to prevent condensation of said heat transfer fluid therealong.

14. An atomizing apparatus comprising:

a source of heat transfer fluid;

a sealed chamber having a first wall, a second wall and at least one side wall extending therebetween, said first wall having an exterior surface and an interior surface, said exterior surface being configured to engage a heated surface, the heated surface being arranged externally of said sealed chamber, said interior surface being arranged inside said sealed chamber, said first wall being configured to conduct heat from the heated surface and transfer at least a portion of the heat to said interior surface, said first wall opposing said second wall, said second wall having an exterior surface and an interior surface arranged inside said sealed chamber, said interior surface of said second wall being a cool surface relative to the heated surface and being adapted to receive a droplet of said heat transfer fluid; and means for controlling a vibration of a droplet of said heat transfer fluid received on said interior surface of said second wall, the vibration of the droplet being at a frequency less than ultrasonic such that a spray of atomized droplets is formed from said droplet of said heat transfer fluid, the vibration being configured to form, on said droplet, surface waves having a smaller wavelength than a diameter of said droplet, thereby ejecting and propelling said atomized droplets from said droplet.

15. The atomizing apparatus of claim 14, further comprising:

a piezoelectric element engaging said interior surface of said second wall and electrically communicating with said means for controlling a vibration of a droplet such that said piezoelectric element vibrates said interior surface of said second wall in response to said means for controlling a vibration of a droplet.

16. The atomizing apparatus of claim 14, wherein said exterior surface of said second wall is configured to engage a cooling device, said cooling device being configured to maintain said cool surface at a temperature cooler than a temperature of said interior surface of said first wall.

17. The atomizing apparatus of claim 14, wherein said at least one side wall comprises means for preventing condensation of said heat transfer fluid along said at least one side wall.

* * * * *